US006994598B2

(12) United States Patent
Holmes et al.

(10) Patent No.: US 6,994,598 B2
(45) Date of Patent: Feb. 7, 2006

(54) POWER WIRE TO PRINTED CIRCUIT BOARD CONNECTOR ASSEMBLY AND A METHOD THEREOF

(75) Inventors: Liam Holmes, County Cork (IE); Martin O'Donnell, County Cork (IE)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/833,406

(22) Filed: Apr. 28, 2004

(65) Prior Publication Data

US 2004/0235320 A1 Nov. 25, 2004

Related U.S. Application Data

(60) Provisional application No. 60/468,345, filed on May 6, 2003.

(51) Int. Cl.
*H01R 13/40* (2006.01)

(52) U.S. Cl. ..... 439/752.5; 439/752; 439/839

(58) Field of Classification Search ..... 439/752.5, 439/752, 839, 857, 856, 79, 701
See application file for complete search history.

(56) References Cited

U.S. PATENT DOCUMENTS 5,002,504 A * 3/1991 Carlson ..... 439/599
5,197,908 A * 3/1993 Nelson ..... 439/825
5,653,613 A * 8/1997 Shimoda ..... 439/752
5,916,002 A * 6/1999 Gottschalk et al. ..... 439/839
5,928,034 A * 7/1999 Tabata et al. ..... 439/595
6,183,312 B1 * 2/2001 Yamamoto ..... 439/748
6,375,501 B1 * 4/2002 Kojima ..... 439/595
6,390,860 B2 * 5/2002 Shirouzu et al. ..... 439/752.5
6,589,084 B1 * 7/2003 Frank ..... 439/839
6,666,730 B2 * 12/2003 Canuto et al. ..... 439/752

* cited by examiner

*Primary Examiner*—Gary Paumen
(74) *Attorney, Agent, or Firm*—Nixon Peabody LLP

(57) ABSTRACT

An electrical connector assembly includes a housing with at least one through passage, at least one socket contact, at least one pin contact, and at least one pin plate. The socket contact is at least partially disposed in one end of the through passage in the housing and has a socket passage. The pin contact is at least partially disposed in another end of the through passage in the housing and detachably mates with the socket passage. The socket plate is detachably secured to the housing about the socket contact adjacent the one end of the through passage. The pin plate which is detachably secured to the housing about the pin contact adjacent the other end of the through passage.

24 Claims, 8 Drawing Sheets

POWER WIRE TO PRINTED CIRCUIT BOARD CONNECTOR ASSEMBLY AND A METHOD THEREOF

This application claims the benefit of U.S. Provisional Patent Application Ser. No. 60/468,345 filed May 6, 2003 which is hereby incorporated by reference in its entirety.

FIELD OF THE INVENTION

This invention generally relates to electrical connectors and, more particularly, to a compact power wire-to-printed circuit board (PCB) connector assembly and a method thereof.

BACKGROUND

Previous designs for connectors have been complex with numerous intricate component parts that are difficult and time consuming to assemble together. Additionally, the large number and intricate nature of the parts of these connectors has made these connector designs expensive to manufacture. Further, these connector designs have suffered in some applications because they have not been designed to withstand high temperatures ranges.

SUMMARY

An electrical connector assembly in accordance with the embodiments of the present invention includes a housing with at least one through passage, and electrical connector, and a plate. The electrical connector is at least partially disposed in at least a portion of the through passage in the housing. The plate is detachably secured to the housing about the electrical connector and adjacent one end of the through passage.

A method for making a connector assembly in accordance with the embodiments of the present invention includes providing a housing with at least one through passage. An electrical connector is at least partially disposed in at least a portion of the through passage in the housing. A plate is detachably secured to the housing about the electrical connector and adjacent one end of the through passage.

An electrical connector assembly in accordance with the embodiments of the present invention includes a housing with at least one through passage, at least one socket contact, at least one pin contact, and at least one pin plate. The socket contact is at least partially disposed in one end of the through passage in the housing and has a socket passage. The pin contact is at least partially disposed in another end of the through passage in the housing and detachably mates with the socket passage. The socket plate is detachably secured to the housing about the socket contact adjacent the one end of the through passage. The pin plate which is detachably secured to the housing about the pin contact adjacent the other end of the through passage.

A method of making an electrical connector assembly in accordance with the embodiments of the present invention includes providing a housing with at least one through passage. At least one socket contact is at least partially disposed in one end of the through passage in the housing and the socket contact has a socket passage. At least one pin contact is at least partially disposed in another end of the through passage in the housing and detachably mates with the socket passage. The socket plate is detachably secures plate to the housing about the socket contact adjacent the one end of the through passage. The pin plate is detachably secured to the housing about the pin contact adjacent the other end of the through passage.

The present invention provides a connector assembly which has fewer parts than prior connector assemblies making the connector assembly easier and less expensive to manufacture. Additionally, the connector assembly in accordance to the present invention is also easy for an operator to use. Further, the connector assembly is able to handle high voltage ratings up to 600 volts AC/DC, can withstand high temperatures and is hot pluggable.

DETAILED DESCRIPTION

Figure 1A:
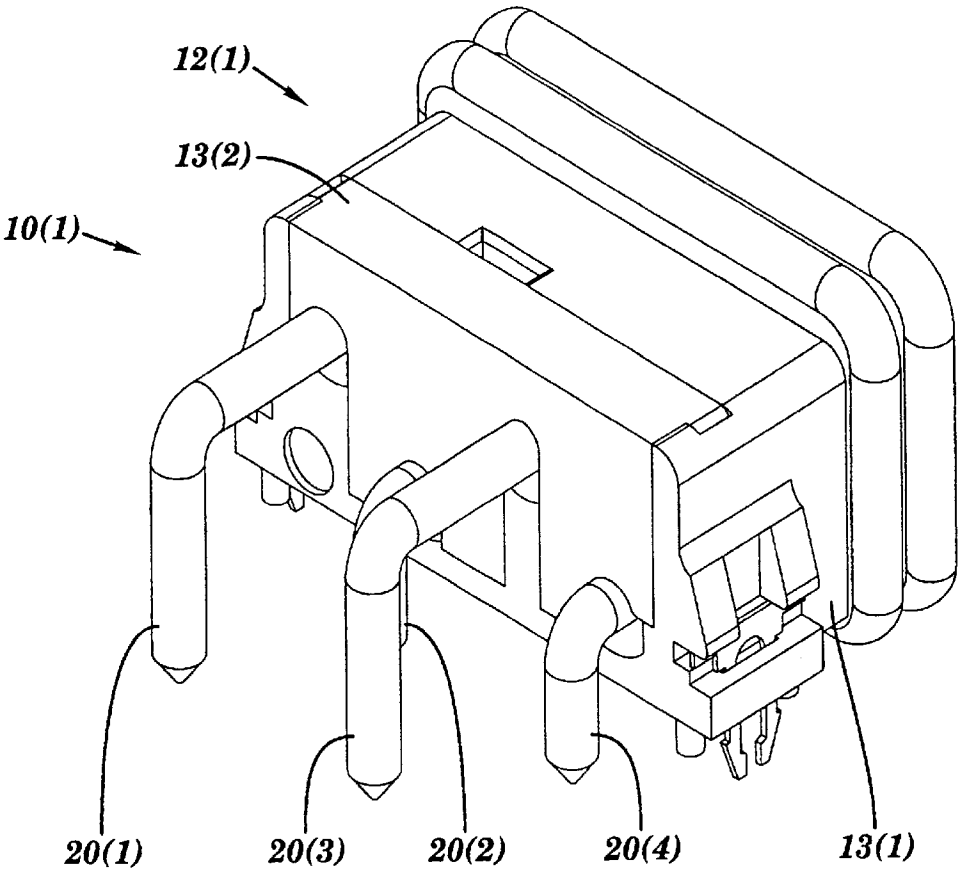
FIG. 1A is a perspective view of one end a connector assembly in accordance with one embodiment of the present invention.
Figure 1B:
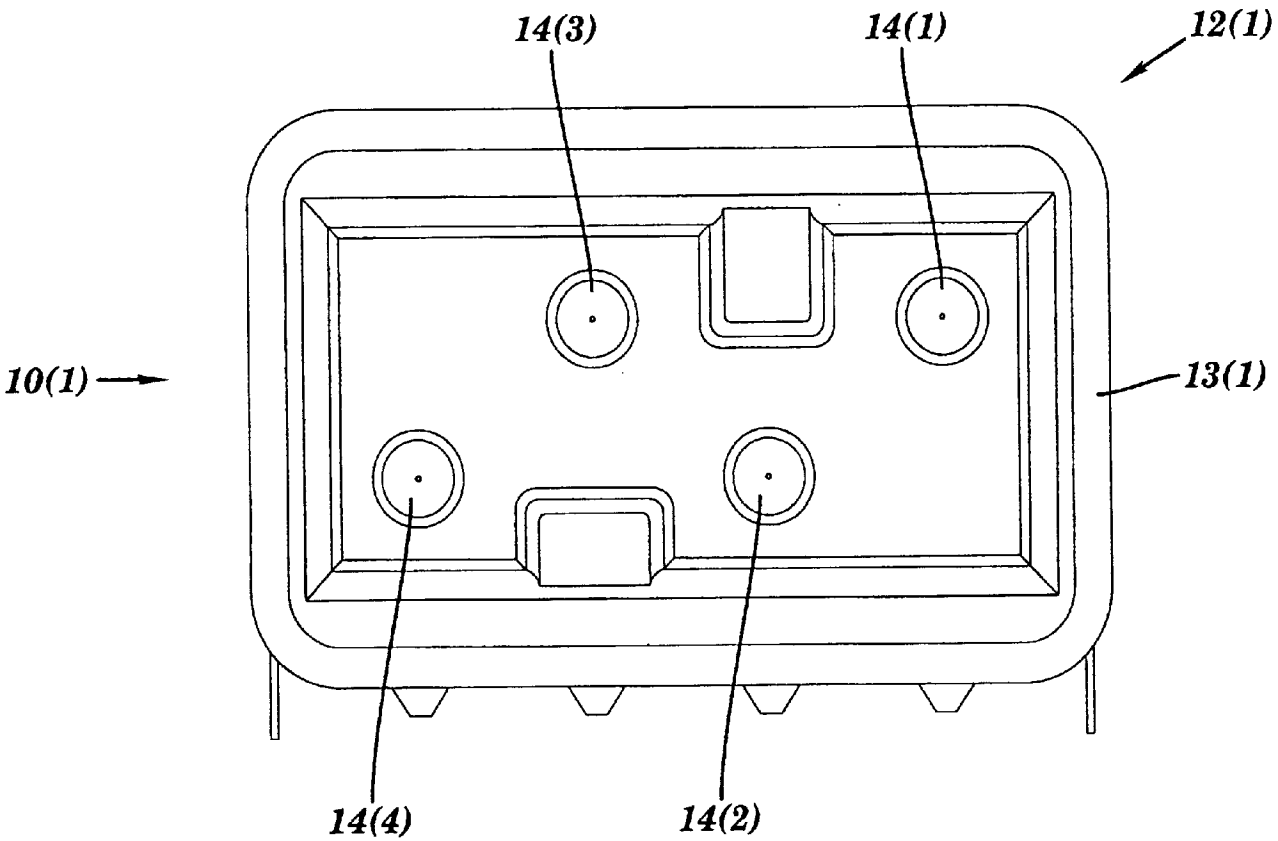
FIG. 1B is an end view of an opposing end of the connector assembly shown in FIG. 1A.
Figure 1C:
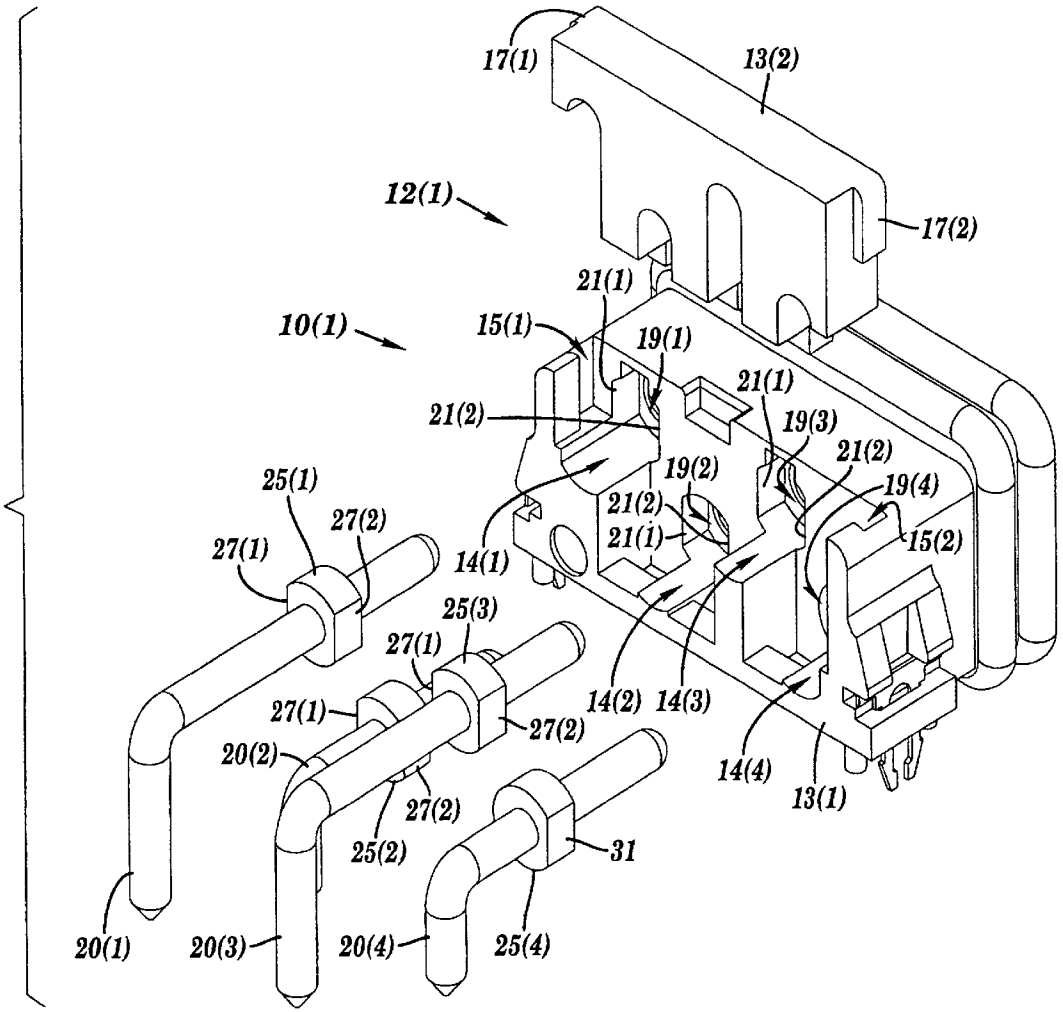
FIG. 1C is a an exploded, perspective view of one end of the connector assembly shown in FIG. 1A.

An electrical connector assembly 10(1) in accordance with embodiments of the present invention is illustrated in FIGS. 1A–1C. The connector assembly 10(1) includes a housing 12(1), through passages 14(1)–14(4), pin contacts 20(1)–20(4), and pin plate 28(1), although the electrical connector assembly 10(1) can comprise other numbers and types of components in other configurations, such as the connector assemblies 10(2) and 10(3) illustrated in FIGS. 2A, 2B, and 4. The present invention provides a connector assembly which has fewer parts than prior connector assemblies making the connector assembly easier and less expensive to manufacture.

Referring to FIGS. 1A–1C, the connector assembly 10(1) includes a housing 12(1) which is used to secure one end of the pin contacts 20(1)–20(4) for connection to power wires or connectors, although the housing 12(1) could be configured for other types of connections. The housing 12(1) includes a pin plate 13(2) which is sized and shaped to mate with a base 13(1) by a detachable snap lock engagement, although the housing 12(1) can comprise other numbers and types of components which are detachably connected together in other manners. More specifically, the housing 12(1) includes a pair of opposing channels 15(1) and 15(2) in which tabs 17(1) and 17(2) on the pin plate 13(2) can be seated for a detachable snap lock engagement, although other manners for detachably engaging the pin plate 13(2) to the base 13(1) can be used. The housing 12(1) is made of a material which can withstand high temperatures of up to about 120 degrees Centigrade and high voltages, although other types of materials can be used.

The housing 12(1) with the base 13(1) and the pin plate 13(2) defines four through passages 14(1)–14(4), although the housing 12(1) can define other numbers of passages with other configurations. The passages 14(1)–14(4) are each sized and shaped to mate with portions of pin contacts 20(1)–20(4), respectively. In this particular embodiment, the portion of each of the passages 14(1)–14(3) in the housing 12(1) has an inner periphery with a substantially round shape, except each of the passages 14(1)–14(3) has a passage sections 19(1)–19(3) which is enlarged. The inner periphery of each of the enlarged passage sections 19(1)–19(3) also have a substantially round shape, except each of the sections 19(1)–19(3) has a pair of opposing flat edges 21 (1) and 21(2). The portion of the passage 14(4) in the housing 12(1) also defines an inner periphery with a substantially round shape, except the passage 14(4) has a passage section 19(4) which is enlarged. The inner periphery of the enlarged passage section 19(4) also has a substantially round shape, except for one flat edge. The particular location of the flat edges in each of the passage sections 19(1)–19(4) orient the pin contacts 20(1)–20(4) in the passages 14(1)–14(4). Although one shape for the inner periphery of the passages 14(1)–14(3) along with the enlarged passage sections 19(1)–19(3) and another shape for the inner periphery of the passage 14(4)) along with the enlarged passage section 19(4) are disclosed, the inner peripheries of the passages 14(1)–14(4) and/or the passage sections 19(1)–19(4) can have other configurations, such as having one or more passages 14(1)–14(4) with other shapes for the inner periphery or one or more passage sections 19(1)–19(4) comprising a reduced sections or having other shapes for the inner periphery.

The pin contacts 20(1)–20(4) have an L-shape and couple a printed-circuit board (not shown) to power wires or connectors in the housing 12(1), although the pin contacts 20(1)–20(4) could have other shapes and can be coupled to other components. The pin contacts 20(1) and 20(3) are longer than the pin contacts 20(2) and 20(4), although each of the pin contacts 20(1)–20(4) could have other lengths. Differences in the length of the pin contacts can be useful in establishing make first and break last configurations.

In this particular embodiment, a portion of outer periphery of each of the three pin contacts 20(1)–20(3) has a substantially round shape, except for a protruded sections 25(1)–25(3), although each of the pin contacts 20(1)–20(3) could have other shapes with other numbers and types of sections, such as a recessed section. The protruded sections 25(1)–25(3) have an outer periphery with a substantially round shape, except for a pair of opposing flat edges 27(1) and 27(2), although each of the protruded sections 25(1)–25(3) sections, could have other shapes with other numbers and types of sections, such as a recessed section. A portion of outer periphery of each of the pin contacts 20(4) also has a substantially round shape, except for a protruded section 25(4), although the pin contact 20(4) could have other shapes with other numbers and types of sections, such as a recessed section. The protruded section 25(4) has an outer periphery with a substantially round shape, except for a flat edge 31, although the protruded section 25(4), could have other shapes with other numbers and types of sections, such as a recessed section.

The protruded sections 25(1)–25(4) on the pin contacts 20(1)–20(4) form keying elements which mate with the passage sections 19(1)–19(4) in the through passages 14(1)–14(4) to make sure that the correct one of pin contacts 20(1)–20(4) is seated in the correct one of passage 14(1)–14(4), although other types of keying arrangements can be used. More specifically, the protruded sections 25(1)–25(3) mate with the passage section 19(1)–19(3), respectively, with the flat edges 27(1) and 27(2) mating with the flat edges 21(1) and 21(2). The protruded section 25(4) mates with the passage section 19(4) with flat edge 31 mating with the flat edge in the passage section 19(4). Although one number and configuration of pin contacts 20(1)–20(4) in passages 14(1)–14(4), other numbers and configurations for the pin contacts and passages can be used.

A method for making a connector assembly 10(1) in accordance with embodiments of the present invention will now be described with reference to FIGS. 1A–1C. The pin plate 13(2) is detached from the base 13(1) by sliding the tabs 17(1) and 17(2) on the pin plate 13(2) out from the frictional engagement with the channels 15(1) and 15(2) in the base 13(1).

Next, each of the pin contacts 20(1)–20(4) are positioned and oriented in the passages 14(1)–14(4) so that the protruded sections 25(1)–25(4) on the pin contacts 20(1)–20(4) each mate with one of the passage sections 19(1)–19(4). These keying elements help to make sure that the correct one of the pin contacts 20(1)–20(4) is seated in the correct one of the passage 14(1)–14(4), although other types of keying arrangements can be used. More specifically, the protruded sections 25(1)–25(3) mate with the passage section 19(1)–19(3), respectively, with the flat edges 27(1) and 27(2) mating with the flat edges 21(1) and 21(2). Additionally, the protruded section 25(4) mates with the passage section 19(4) with flat edge 31 mating with the flat edge in the passage section 19(4).

Once the pin contacts 20(1)–20(4) are properly oriented in the passages 14(1)–14(4), then the pin plate 13(2) is detachably engaged to the base 13(1) by sliding the tabs 17(1) and 17(2) on the pin plate 13(2) into frictional engagement with the channels 15(1) and 15(2) in the base 13(1) to form a snap lock arrangement. The ends of the pin contacts 20(1)–20(4) that are not disposed in the housing 12(1) can be coupled to other components, such as a PCB.

Referring to FIGS. 2A, 2B, 3A, and 3B, a connector assembly 10(2) in accordance with other embodiments of the present invention is illustrated. Elements in the connector assembly 10(2) which are like those in the connector assembly 10(1) will have like reference numerals and will not be described in detail again.

Figure 2A:
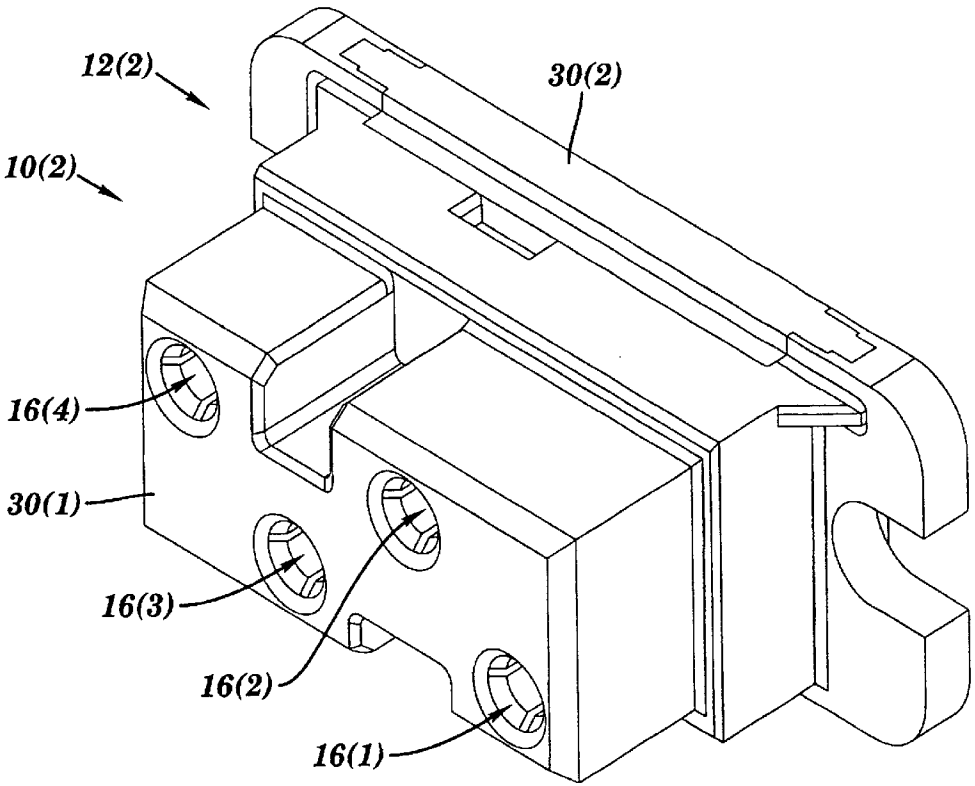
FIG. 2A is a perspective view of one end a connector assembly in accordance with another embodiment of the present invention.
Figure 2B:
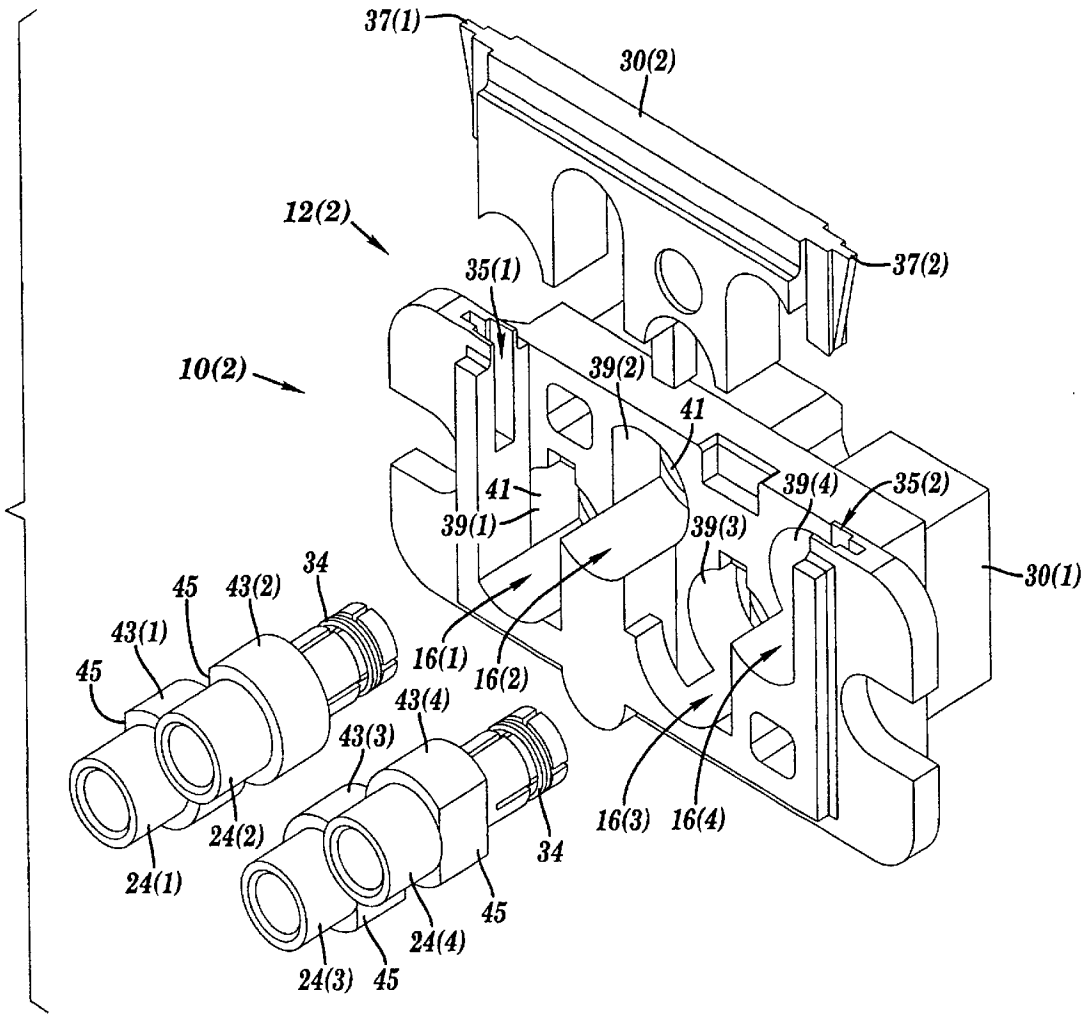
FIG. 2B is a an exploded, perspective view of one end of the connector assembly shown in FIG. 2A.
Figure 3A:
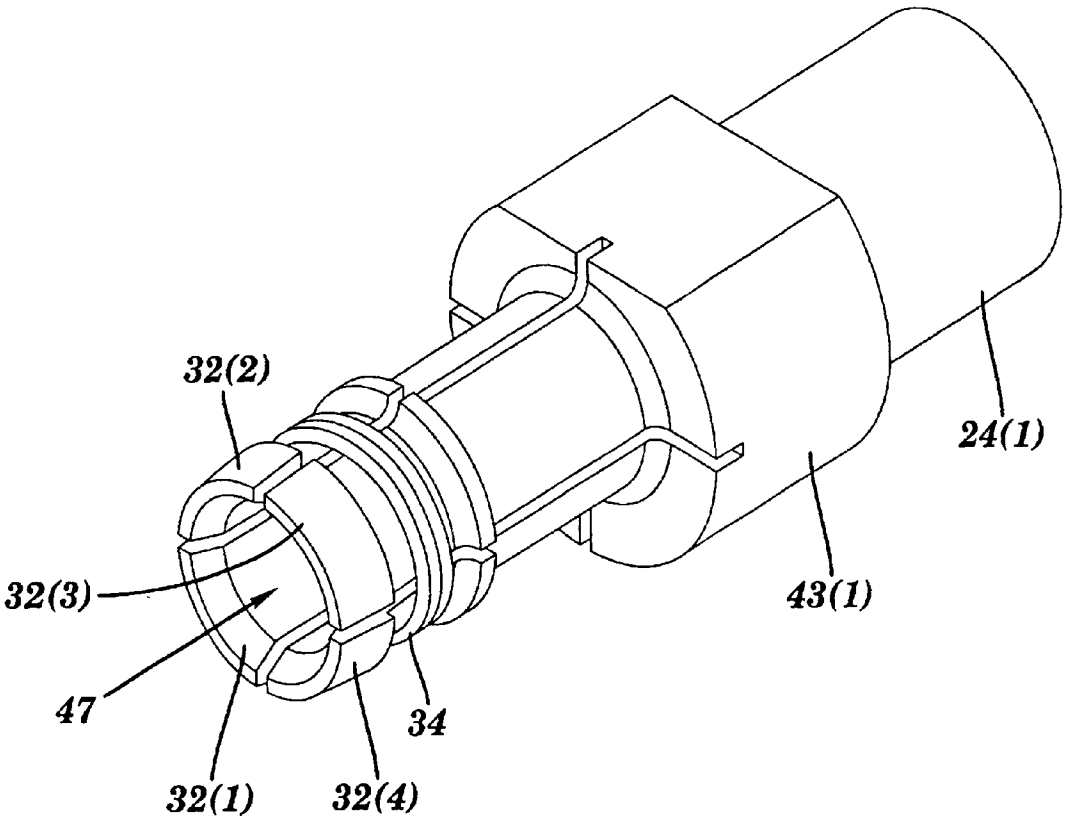
FIG. 3A is a perspective view of a socket contact in the connection assembly.
Figure 3B:
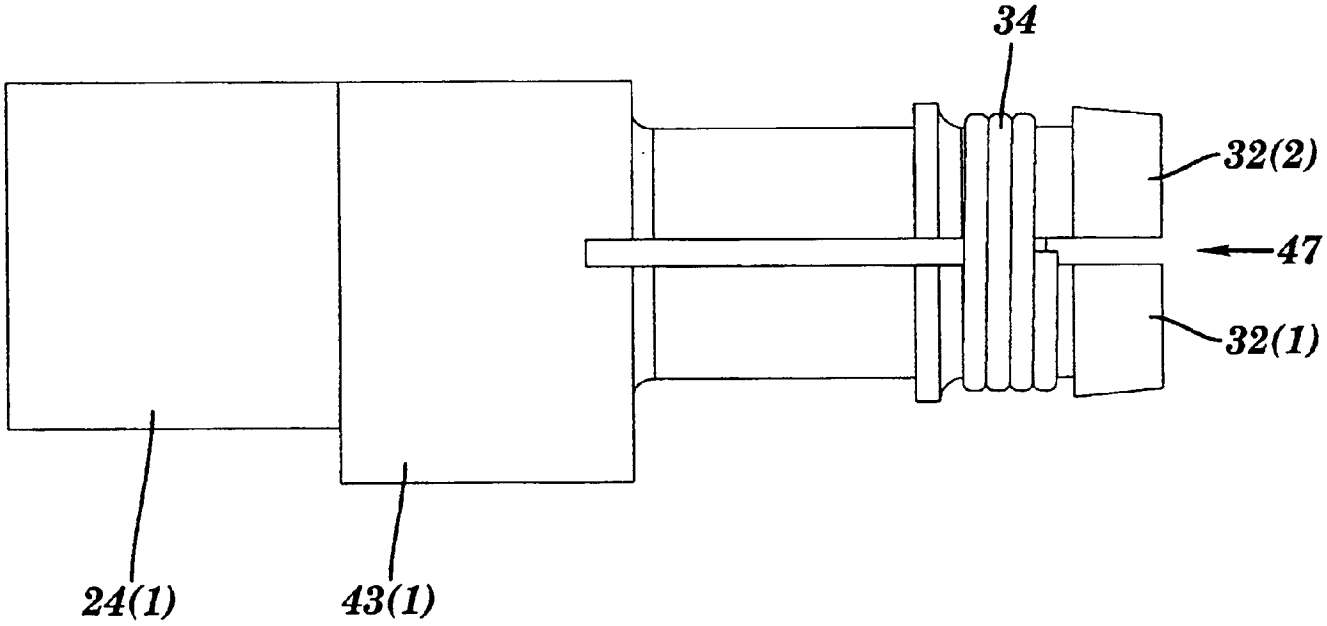
FIG. 3B is a cross-sectional view of the socket.

Referring to FIGS. 2A and 2B, the connector assembly 10(1) includes a housing 12(2) which is used to secure one end of a set of socket contacts 24(1)–24(4) for connection to power wires or connectors, although the housing 12(2) could be configured for other types of connections. The housing 12(2) includes a socket plate 30(2) which is sized and shaped to mate with a base 30(1) by a detachable snap lock engagement, although the housing 12(2) can comprise other numbers and types of components which are detachably connected together in other manners. More specifically, the housing 12(2) includes a pair of opposing channels 35(1) and 35(2) in which tabs 37(1) and 37(2) on the socket plate 30(2) can be seated for a detachable snap lock engagement, although other manners for detachably engaging the pin plate 30(2) to the base 30(1) can be used. The housing 12(2) is also made of a material which can withstand high temperatures of up to about 120 degrees Centigrade and high voltages, although other types of materials can be used.

The housing 12(2) with the base 39(1) and the pin plate 32(2) defines four through passages 16(1)–16(4), although the housing 12(2) can define other numbers of passages with other configurations. The passages 16(1)–16(4) are each sized and shaped to mate with portions of socket contacts 24(1)–24(4), respectively. In this particular embodiment, the portion of each of the passages 16(1)–16(4) in the housing 12(2) has an inner periphery with a substantially round shape, except each of the passages 16(1)–16(4) has a passage sections 39(1)–39(4) which is enlarged. The inner periphery of each of the enlarged passage sections 39(1)–39(4) also have a substantially round shape, except each of the sections 39(1)–39(4) has flat edge 41. The particular location of the flat edge 41 in each of the passage sections 39(1)–39(4) orient the socket contacts 24(1)–24(4) in the passages 16(1)–16(4). Although one shape for the inner periphery of the passages 16(1)–16(4) along with the enlarged passage sections 39(1)–39(4) is disclosed, the inner peripheries of the passages 16(1)–16(4) and/or the passage sections 39(1)–19(4) can have other configurations, such as having one or more passages 16(1)–16(4) with other shapes for the inner periphery or one or more passage sections 39(1)–39(4) comprising a reduced sections or having other shapes for the inner periphery.

The socket contacts 24(1)–24(4) have a substantially straight shape and couple power wires or connectors to the housing 12(1) for coupling to other components, although the socket contacts 24(1)–24(4) could have other shapes and can be coupled to other elements. In this particular embodiment, a portion of outer periphery of each of the four socket contacts 24(1)–24(4) has a substantially round shape, except for a protruded section 43(1)–43(4), although each of the socket contacts 24(1)–24(4) could have other shapes with other numbers and types of sections, such as a recessed section. The protruded sections 43(1)–43(4) have an outer periphery with a substantially round shape, except for a flat edge 45, although each of the protruded sections 43(1)–43(4) sections, could have other shapes with other numbers and types of sections, such as a recessed section.

The protruded sections 43(1)–43(4) on the socket contacts 24(1)–24(4) form keying elements which mate with the passage sections 39(1)–39(4) in the through passages 16(1)–16(4) to make sure that the correct one of socket contacts 24(1)–24(4) is seated in the correct one of passage 16(1)–16(4), although other types of keying arrangements can be used. More specifically, the protruded sections 43(1)–43(4) mate with the passage section 39(1)–39(4), respectively, with the flat edge 45 mating with the flat edge 41. Although one number and configuration of socket contacts 24(1)–24(4) in passages 16(1)–16(4), other numbers and configurations for the pin contacts and passages can be used.

Referring to FIGS. 2A, 2B, 3A, and 3B, the socket contacts 24(1)–24(4) each have a plurality of tines 32(1)–32(4). The tines 32(1)–32(4) for each of the socket contacts 24(1)–24(4) are arranged to define a socket passage 47, although each of the socket contacts 24(1)–24(4) could have other numbers and shapes for the tines and could have other configurations for defining a socket passage other than tines. The socket passages 47 for each of the socket contacts 24(1)–24(4) are each used to mate with one end of a pin contact, although the socket passages 24(1)–24(4) can be configured to mate with other types of connectors. Each of the socket contacts 24(1)–24(4) are machined from copper and plated with silver, although the socket contacts 24(1)–24(4) could be made of other materials. A coil spring 34 is seated over the tines 32(1)–32(4) for each of the socket contacts 24(1)–24(4) to add a retention and contact force for making an electrical connection.

A method for making a connector assembly 10(2) in accordance with other embodiments of the present invention will now be described with reference to FIGS. 2A, 2B, 3A, and 3B. The socket plate 30(2) is detached from the base 30(1) by sliding the tabs 37(1) and 37(2) on the socket plate 30(2) out from the frictional engagement with the channels 35(1) and 35(2) in the base 30(1).

Next, each of the socket contacts 24(1)–24(4) are positioned and oriented in the passages 16(1)–16(4) so that the protruded sections 43(1)–43(4) on the socket contacts 24(1)–24(4) each mate with one of the passage sections 39(1)–39(4). These keying elements help to make sure that the correct one of the socket contacts 24(1)–24(4) is seated in the correct one of the passage 16(1)–16(4), although other types of keying arrangements can be used. More specifically, the protruded sections 43(1)–43(4) mate with the passage sections 39(1)–39(4), respectively, with the flat edge 45 of each of the protruded sections 43(1)–43(4) mating with the flat edge 41 in one of the passage sections 39(1)–39(4).

Once the socket contacts 24(1)–24(4) are properly oriented in the passages 16(1)–16(4), then the socket plate 30(2) is detached engaged to the base 30(1) by sliding the tabs 37(1) and 37(2) on the socket plate 30(2) into frictional engagement with the channels 35(1) and 35(2) in the base 30(1) to form a snap lock arrangement. The ends of the socket contacts 24(1)–24(4) that are not disposed in the housing 12(2) can be coupled to other components.

Figure 4:
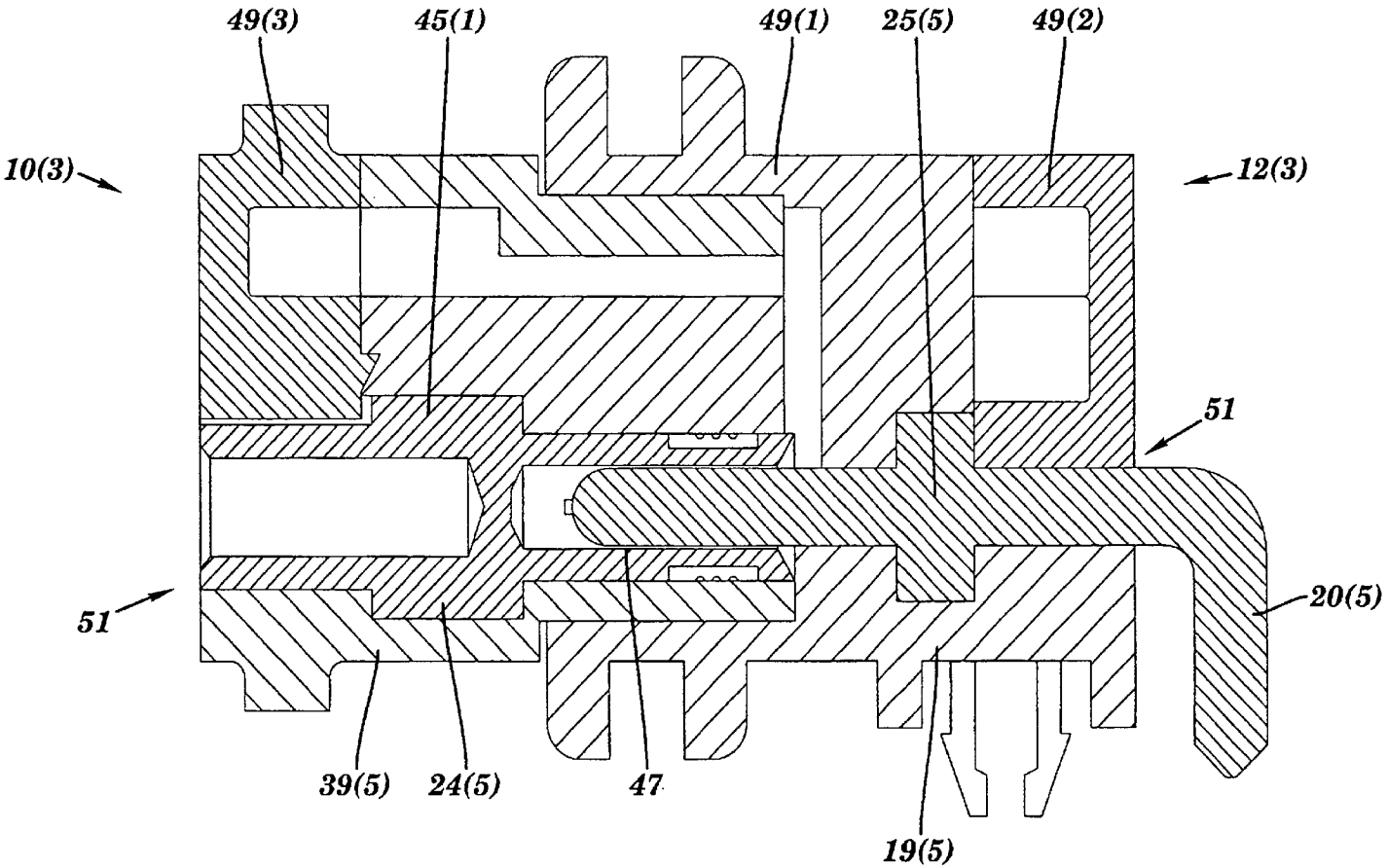
FIG. 4 is a cross-sectional view of a connector assembly in accordance with yet another embodiment of the present invention.

Referring to FIG. 4, a connector assembly 10(3) in accordance with another embodiment of the present invention is illustrated. Elements in the connector assembly 10(3) which are like those in the connector assembly 10(1) or in connector assembly 10(2) will have like reference numerals and will not be described in detail again.

The housing 12(3) includes a pin plate 49(2) which is sized and shaped to mate with a base 49(1) by a detachable snap lock engagement and with a socket plate 49(3) which also is sized and shaped to mate with the base 49(1) by a detachable snap lock engagement, although the housing 12(3) can comprise other numbers and types of components which are detachably connected together in other manners. The housing 12(3) is made of a material which can withstand high temperatures of up to about 120 degrees Centigrade and high voltages, although other types of materials can be used.

The housing 12(3) with the base 49(1), the pin plate 49(2), and the socket plate 49(3) define a through passage 51, although the housing 12(3) can define other numbers of passages with other configurations. The passage 51 is sized and shaped to mate with portions of a pin contact 20(5) and 51 is sized and shaped to mate with portions of a socket contact 24(5). In this particular embodiment, the portion of the passage 51 in the housing 12(3) has an inner periphery with a substantially round shape, except for passage sections 19(5) and 39(5) which are s enlarged. Although one shape for the inner periphery of the passage 51 along with the enlarged passage sections 19(5) and 39(5) are disclosed, the inner peripheries of the passage 51 and/or the passage sections 19(5) and 39(5) can have other configurations, such as having another shape for the passage 51 or the passage sections 19(5) and/or 39(5), such as having a reduced section or having another shape for the inner periphery.

The pin contact 20(5) has an L-shape and is used to couple a printed-circuit board (not shown) to a power wire or connector in the housing 12(3), although the pin contact 20(5) could have other shapes and can be coupled to other elements. In this particular embodiment, a portion of the outer periphery of the pin contacts 20(5) has a substantially round shape, except for a protruded sections 25(5), although the pin contact 25(5) could have other shapes with other numbers and types of sections, such as a recessed section.

The socket contact 24(5) has a substantially straight shape and couples a power wire or connector to the housing 12(3) for coupling to other components, although the socket contact 24(5) could have other shapes and can be coupled to other elements. In this particular embodiment, a portion of outer periphery of the socket contact 24(5) has a substantially round shape, except for a protruded section 43(5), although the socket contact 24(5) could have other shapes with other numbers and types of sections, such as a recessed section. One end of the pin contact 24(5) is seated in the socket passage 47 in the socket contact 24(5) to form an electrical connection.

The protruded section 25(5) on the pin contact 20(5) and the protruded section 43(5) on the socket contact 24(5) form keying elements which mate with the passage sections 19(5) and 39(5), respectively, in the through passage 51 to make sure the correct pin contacts 20(5) and socket contact 24(5) are properly connected, although other types of keying arrangements can be used. More specifically, the protruded section 25(5) for the pin contact 20(5) mates with the passage section 19(5) and the protruded section 45(1) for the socket contact 24(5) mates with the passage section 39(5). Although one configuration of pin contacts 20(5) and socket contact 24(5) is shown, other configurations for the pin and socket contacts in the passage can be used.

A method for making a connector assembly 10(3) in accordance with embodiments of the present invention will now be described with reference to FIGS. 1A–1C. The pin plate 49(2) and the socket plate 49(3) are both detached from a snap lock engagement with the base 49(1, although other manners for securing the pin plate 49(2) and the socket plate 49(3) to the base 49(1) can be used.

Next, the socket contact 24(5) is positioned and oriented in another portion of the passage 51 so that the protruded section 45(1) on the socket contact 24(5) mates with the passage section 39(5). Additionally, the pin contact 20(5) is positioned and oriented in a portion of the passage 51 so that the protruded section 25(5) on the pin contact 20(5) mates with the passage section 19(5). The end of the pin contact 20(5) in the housing 12(3) is also positioned to be detachably mated in the socket passage 47 in one end of the socket contact 24(5).

Once the pin contact 20(5) and the socket contact 24(5) are properly oriented in the passage 51, then the pin plate 49(2) and the socket plate 49(3) are detachably engaged to the base 13(1) using a snap lock arrangement. The ends of the pin contact 20(5) and the socket contact 24(5) that are not disposed in the housing 12(3) can be coupled to other components.

Accordingly, as illustrated in the exemplary embodiments described herein, the present invention provides a connector assembly which has fewer parts than prior connector assemblies making the connector assembly easier and less expensive to manufacture. Additionally, the connector assembly in accordance to the present invention is also easy for an operator to use. Further, the connector assembly is designed to handle high voltage ratings up to 600 volts AC/DC, can withstand high temperatures and is hot pluggable

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. An electrical connector assembly comprising:

a housing with two or more through passages;

two or more electrical contacts, wherein each of the electrical contacts is at least partially disposed in at least a portion of one of the through passages in the housing;

at least one keying element on each of the electrical contacts, wherein each of the through passages has a size and shape which mates with the at least one keying element on one of the electrical contacts and wherein at least two of the through passages and the at least one keying element on at least two of the electrical contacts have at least one of a different size and shape; and a plate detachably secured to the housing about the electrical contacts and adjacent one end of the through passage to secure the electrical contacts.

2. The assembly as set forth in claim 1 wherein at least one of the keying elements is at least one protruded section on one of the electrical contacts.

3. The assembly as set forth in claim 1 wherein at least one of the electrical contacts comprises a pin contact.

4. The assembly as set forth in claim 1 wherein at least one of the electrical contacts comprises a socket contact.

5. The assembly as set forth in claim 4 wherein the socket contact comprises a base and a plurality of tines which extend from the base and define a socket passage.

6. The assembly as set forth in claim 1 wherein the electrical contact comprises a socket contact which comprises a base and a plurality of tines which extend from the base and define a socket passage and further comprising a spring positioned about the plurality of tines.

7. An electrical connector assembly comprising:

a housing with at least one through passage;

an electrical contact at least partially disposed in at least a portion of the through passage in the housing, wherein the electrical contact comprises a socket contact which comprises a base and a plurality of tines which extend from the base and define a socket passage;

a spring positioned about the plurality of tines; and a plate detachably secured to the housing about the electrical contact and adjacent one end of the through passage.

8. A method for making a connector assembly, the method comprising:

providing a housing with two or more through passages;

at least partially disposing two or more electrical contacts each in at least a portion of one of the through passages in the housing, wherein each of the electrical contacts has at least one keying element and wherein each of the through passages has a size and share which mates with the at least one keying element on one of the electrical contacts and at least two of the through passages and the at least one keying element on at least two of the electrical contacts have at least one of a different size and shape; and detachably securing a plate to the housing about the electrical contacts and adjacent one end of the through passage to secure the electrical contacts.

9. The method as set forth in claim 8 wherein the at least one keying element is at least one protruded section on at least one of the electrical contacts.

10. The method as set forth in claim 8 wherein at least one of the electrical contacts comprises a pin contact.

11. The method as set forth in claim 8 wherein at least one of the electrical contacts comprises a socket contact.

12. The method as set forth in claim 11 wherein the socket contact comprises a base and a plurality of tines which extend from the base and define a socket passage.

13. The method as set forth in claim 8 wherein the electrical contact comprises a socket contact which comprises a base and a plurality of tines which extend from the base and define a socket passage and further comprising placing a spring about the plurality of tines.

14. A method for making a connector assembly, the method comprising:

providing a housing with at least one through passage;

at least partially disposing an electrical contact in at least a portion of the through passage in the housing, wherein the electrical contact comprises a socket contact which comprises a base and a plurality of tines which extend from the base and define a socket passage;

placing a spring about the plurality of tines; and detachably securing a plate to the housing about the electrical contact and adjacent one end of the through passage.

15. An electrical connector assembly comprising:

a housing with at least one through passage;

at least one socket contact at least partially disposed in one end of the through passage in the housing, the socket contact having a socket passage;

at least one pin contact at least partially disposed in another end of the through passage in the housing and detachably mating with the socket passage;

a socket plate detachably secured to the housing about the socket contact adjacent the one end of the through passage; and a pin plate which is detachably secured to the housing about the pin contact adjacent the other end of the through passage.

16. The assembly as set forth in claim 15 further comprising at least one keying element on the socket contact and at least one other keying element on the pin contact, wherein one end of the through passage has a size and shape which mates with the one keying element and another end of the through passage has a size and shape which mates with the other keying element.

17. The assembly as set forth in claim 16 wherein the one keying element is at least one protruded section on the socket contact and the other keying element is at least one protruded section on the pin contact.

18. The assembly as set forth in claim 15 wherein the socket contact comprises a base and a plurality of tines which extend from the base and define a socket passage.

19. The assembly as set forth in claim 18 further comprising a spring positioned about the plurality of tines.

20. A method of making an electrical connector assembly, the method comprising:

providing a housing with at least one through passage;

at least partially disposing at least one socket contact in one end of the through passage in the housing, the socket contact having a socket passage;

at least partially disposing at least one pin contact in another end of the through passage in the housing and detachably mating with the socket passage;

detachably securing a socket plate to the housing about the socket contact adjacent the one end of the through passage; and detachably securing a pin plate to the housing about the pin contact adjacent the other end of the through passage.

21. The method as set forth in claim 20 further comprising providing at least one keying element on the socket contact and at least one other keying element on the pin contact, wherein one end of the through passage has a size and shape which mates with the one keying element and another end of the through passage has a size and shape which mates with the other keying element.

22. The method as set forth in claim 21 wherein the one keying element is at least one protruded section on the socket contact and the other keying element is at least one protruded section on the pin contact.

23. The method as set forth in claim 20 wherein the socket contact comprises a base and a plurality of tines which extend from the base and define a socket passage.

24. The method as set forth in claim 23 further comprising placing a spring about the plurality of tines.

* * * * *